US007290553B2

(12) United States Patent
Prevost

(10) Patent No.: US 7,290,553 B2
(45) Date of Patent: Nov. 6, 2007

(54) FOLDING MODULAR STRUCTURE FOR A TENT OR SIMILAR FOR FAST MOUNTING

(75) Inventor: Philippe Prevost, Hagondange (FR)

(73) Assignee: Utilis, Societe Anonyme, Hagondange (FR)

( * ) Notice: Subject to any disclaimer, the term of this patent is extended or adjusted under 35 U.S.C. 154(b) by 501 days.

(21) Appl. No.: 10/880,420

(22) Filed: Jun. 29, 2004

(65) Prior Publication Data

US 2005/0005960 A1 Jan. 13, 2005

(30) Foreign Application Priority Data

Jul. 1, 2003 (EP) ..... 03360079

(51) Int. Cl.
*E04H 15/48* (2006.01)

(52) U.S. Cl. ..... 135/143

(58) Field of Classification Search ..... 135/120.3, 135/126, 128, 135, 144, 146, 147, 158, 143, 135/139, 140
See application file for complete search history.

(56) References Cited

U.S. PATENT DOCUMENTS 1,170,188 A * 2/1916 Rasmussen et al. ..... 135/149
2,771,896 A * 11/1956 Call ..... 135/140
2,850,027 A * 9/1958 Smith ..... 135/151
4,066,089 A * 1/1978 Rainwater ..... 135/151
4,140,141 A * 2/1979 Marks ..... 135/136
4,667,692 A * 5/1987 Tury et al. ..... 135/156
5,033,493 A * 7/1991 Senchuck ..... 135/149
5,069,238 A * 12/1991 Marks ..... 135/153
5,167,246 A * 12/1992 Mortenson ..... 135/153
5,263,507 A * 11/1993 Chuang ..... 135/140
5,771,651 A * 6/1998 Shiina ..... 52/641
6,173,726 B1 * 1/2001 Talmadge ..... 135/144
6,283,136 B1 * 9/2001 Chen ..... 135/144
6,374,843 B1 * 4/2002 Zou ..... 135/145
2005/0217713 A1 * 10/2005 Chu et al. ..... 135/144

* cited by examiner

*Primary Examiner*—David Dunn
*Assistant Examiner*—Noah Chandler Hawk
(74) *Attorney, Agent, or Firm*—Egbert Law Offices

(57) ABSTRACT

Folding modular structure for a tent or similar for fast mounting includes an assembly of tubular profile bars permitting in particular to form at least two arches facing each other connected by at least two purlins one of which is a ridge. The ridge purlin is formed of the butting of two profile bars, made integral, each by their other end, with a ridge member. That other end includes, on the one hand, a pivoting device for pivoting, in a limited way through an indexing mechanism, on the ridge member according to an axis perpendicular to the plane of the arch. The pivoting device allows the folding back of the shape parallel to the arch, the butting of the two profile bars occurring through encasing means capable of ensuring their immobilization in axial pivoting according to angular positions defined by the indexing mechanism.

7 Claims, 2 Drawing Sheets

FOLDING MODULAR STRUCTURE FOR A TENT OR SIMILAR FOR FAST MOUNTING

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The object of this invention is a folding modular structure for a tent or similar for fast mounting.

The invention refers in particular to the tents adapted for emergency situations, and for military use, i.e. of a relatively small volume when dismantled, that can be mounted and spread out quickly, yet offering a shelter quite resistant to meteorological conditions.

BACKGROUND OF THE INVENTION

In general, a tent includes a structure supporting a canvas, said structure being capable of being disassembled, and comprised for this purpose of the assembly through incasing of tubular profile bars.

If the fact that the structure can be disassembled permits a gain of space for the packaging and transportation of the tent, it generates, on the other hand, disadvantages during the mounting of the structure, in particular in terms of time, because of the numerous parts to be identified before the assembling.

Structures are known which include a series of parallel arches connected two by two by means of junction parts assembled to said arches through encasement, and in which said junction parts are of the pantograph type, in order to permit the bringing closer and/or the bringing apart of the arches. These features are substantially aimed at permitting the enlargement or the shortening of the shelter, and not at facilitating the mounting. Furthermore, this type of structure has, in addition, disadvantages regarding stability.

In order to cope with the above-mentioned disadvantages, and to permit fast mounting and dismantling, it is of course possible to produce folding profile bars, which have however the disadvantage of a relative fragility of the structure because of risks of inopportune folding back, which constitutes a considerable risk, in particular for tents designed for emergency situations exposed to inclement meteorological conditions. Also, this requires using complex and expensive locking system.

BRIEF SUMMARY OF THE INVENTION

The object of this invention is to provide a folding modular structure for a tent or similar for fast mounting, permitting to cope with the various disadvantages mentioned above, yet being of a simple design.

The folding modular structure for a tent or similar for fast mounting according to the invention is of the type comprised of the assembly of tubular profile bars, and designed to support a canvas, said profile bars permitting in particular to form at least two arches facing each other connected by means of at least two purlins one of which is a ridge, and it is characterized essentially in that said ridge purlin is formed of the butting of two profile bars made integral each by their other end with a ridge member that each of said arches include, said end comprising on the one hand pivoting means permitting it to pivot on said ridge member according to an axis perpendicular to the plane of the arch, while indexing means limit angularly said pivoting; and on the other hand pivoting means permitting the articulation of said end according to a transversal axis, parallel to the plane of the arch, in order to permit the folding back of said profile bar parallel to said arch, while the butting of the two profile bars of the ridge purlin occurs through encasing means capable of ensuring the immobilization in axial pivoting of one profile bar with respect to the other one according to angular positions of the latter defined by said indexing means.

According to an additional feature of the structure according to the invention, the connection of the ridge purlin to an arch is made by means of a hinged joint comprising an intermediate member carrying two pivots of axes perpendicular to each other, one of them ensuring the connection to the ridge member perpendicularly to the plane of said arch, while the other one ensures the connection to said ridge purlin.

According to another additional feature of the device according to the invention, the control of the angular orientation of each of the profile bars of the ridge purlin occurs through an indentation provided for in the ridge member and with which co-operates the intermediate member, the shapes of said intermediate member and of said indentation being chosen so as to limit angularly the shifting with respect to each other.

According to another additional feature of the structure according to the invention, the purlin or purlins connecting two arches, other than the ridge purlin, are comprised of two profile bars pivotally articulated on the one hand to each other and on the other hand to their respective arch, in order to permit the folding back onto each other and, hence, the bringing closer of two neighboring arches.

According to another additional feature of the structure according to the invention, the hinge joint connecting the two profile bars constituting a purlin includes reversible blocking means permitting to keep said two profile bars aligned after unfolding.

According to another additional feature of the structure according to the invention, each of the arches is comprised of a ridge member and of two rafters, which are articulated to said ridge member according to distinct axes perpendicular to the plane of the arch.

The advantages and the features of the structure according to the invention will become more evident from the following description that refers to the drawing attached hereto, which represents a non-restrictive embodiment thereof.

DETAILED DESCRIPTION OF THE INVENTION

Figure 1A:
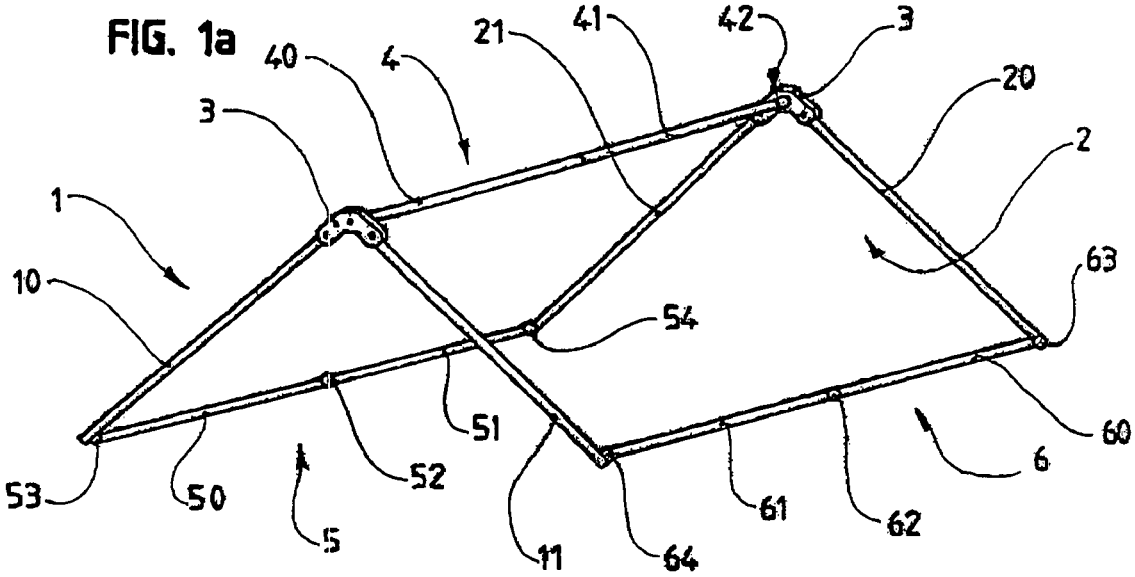
FIGS. 1*a*, 1*b* and 1*c* represent schematic partial perspective views of a folding modular structure according to the invention, in different unfolding positions.
Figure 1B:
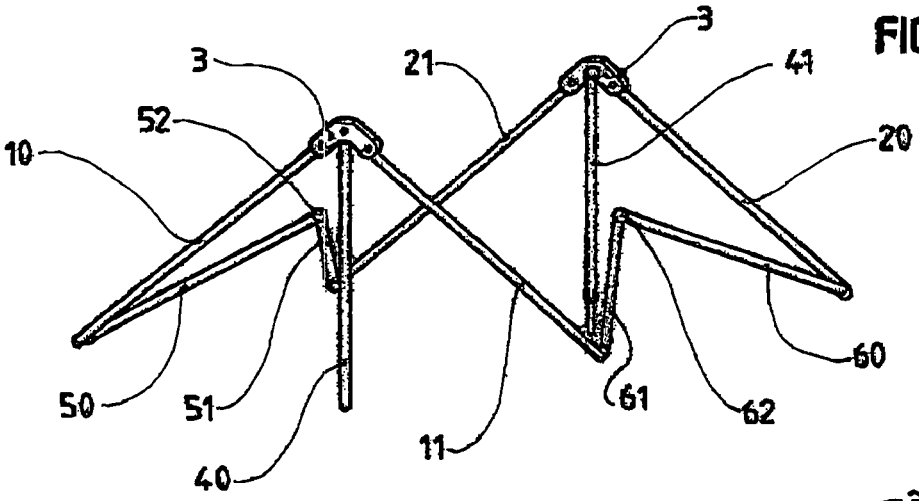
Figure 1C:
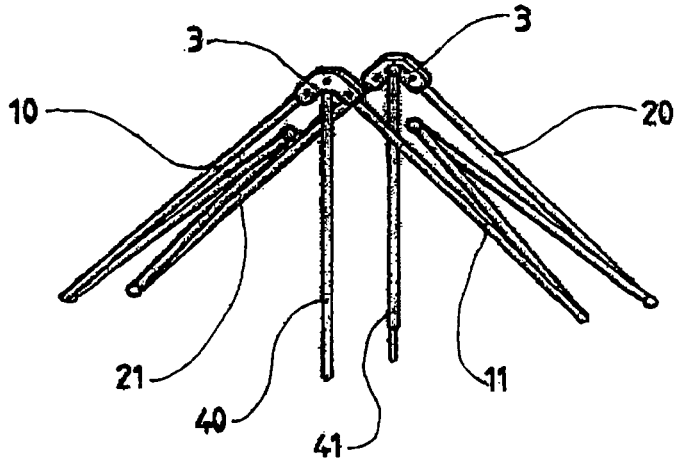

FIGS. 1*a*, 1*b* and 1*c* represent the roof portion of a folding modular structure according to the invention. In this case, this is a two-slope roof, considering that it is possible, although of less common use, to produce a one-slope roof, having the features according to the invention.

Figure 3:
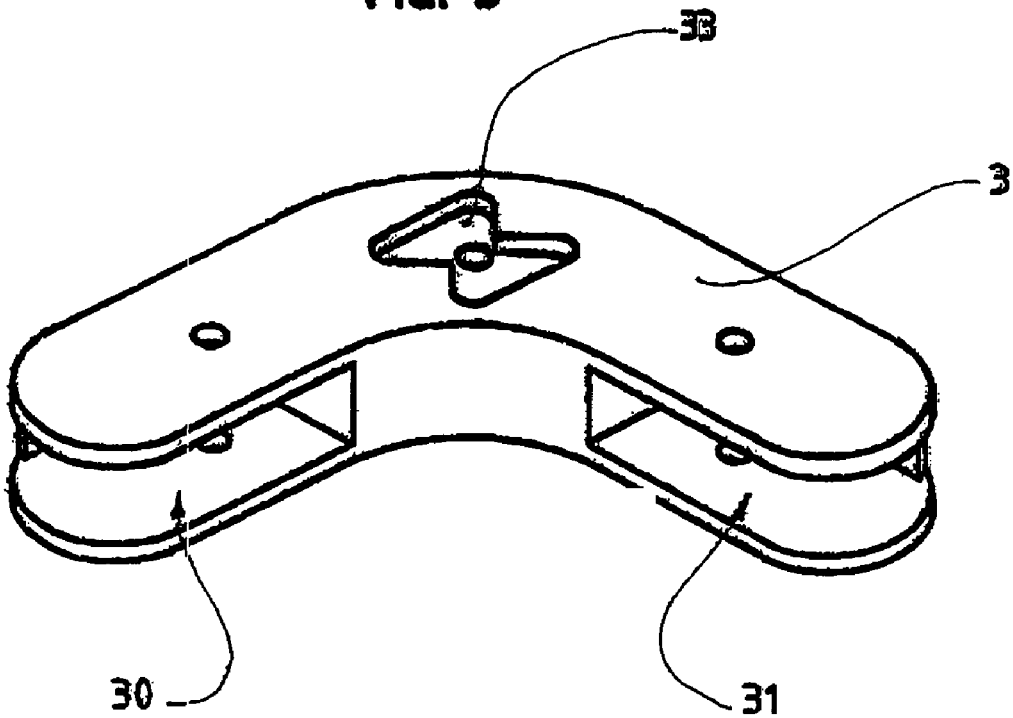
FIG. 3 represents a perspective view of an element of the same structure as in FIGS. 1(*a-c*).

Referring to FIG. 1*a*, it can be seen that the modular structure includes two arches 1 and 2, each in the form of a reverse V and composed of a ridge member 3, represented in detail in FIG. 3, on which are articulated two shapes, or rafters, for each arch 1 and 2, respectively 10 and 11, and 20 and 21.

The two arches 1 and 2 are connected by means of three purlins, a ridge purlin 4 extending between the two ridge members 3, and two purlins 5 and 6 connecting the ends, other than those made integral with the ridge members 3, of the profile bars, 10 and 21, and 11 and 20 respectively.

The purlin 5 is comprised of two profile bars 50 and 51 articulated to each other by means of a hinge joint 52, while the profile bar 50 is connected to the profile bar 10 by means of a hinge joint 53 and the profile bar 51 is connected to the profile bar 21 by means of a hinge joint 54. The pivoting axes of the hinge joints 52, 53 and 54 are parallel, and perpendicular to the plane defined by the profile bars 10 and 21 and the purlins 4 and 5.

Symmetrically, the purlin 6 is comprised of profile bars 60 and 61 connected by means of a hinge joint 62, the profile bar 60 being connected to the profile bar 20 by means of a hinge joint 63, and, the profile bar 61 to the profile bar 11 by means of a hinge joint 64, while the hinge joints 62, 63 and 64 are parallel, and perpendicular to the plane defined by the profile bars 11 and 20 and the purlins 4 and 6.

The ridge purlin 4 is comprised of two profile bars 40 and 41, butted by encasing into each other, with blocking in rotation. The profile bars 40 and 41 are made integral with their respective ridge member 3 by means of a hinge joint 42 comprising two pivoting axes.

Figure 2:
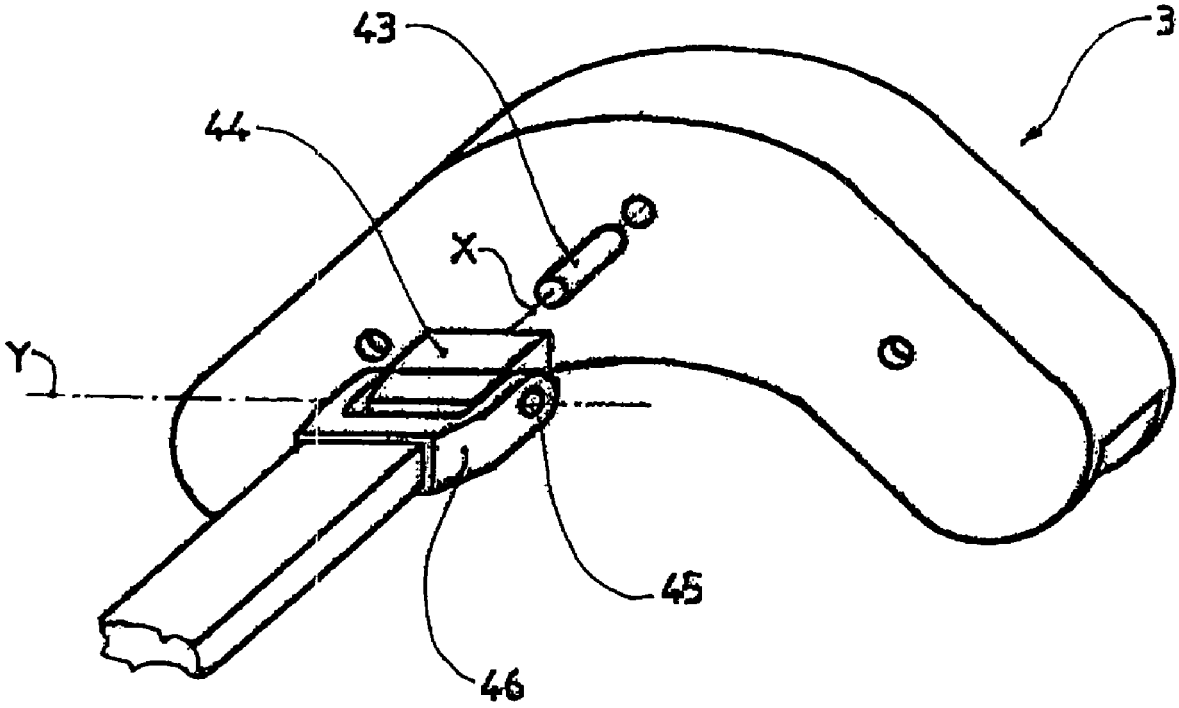
FIG. 2 represents a partial perspective exploded view of the same structure.

Referring to FIG. 2, it can be seen that a hinge joint 42 includes on the one hand a pivot 43 with an axis X perpendicular to the plane of the arch 1, 2, and that enables the connection of the ridge purlin 4 to the ridge member 3 through an intermediate member 44, in turn rotationally mounted on a pivot 45 with a transversal axis Y, perpendicular to the axis X of the pivot 43, and held in a plate 46 made integral with the profile bar 40 or 41.

Furthermore, the profile bars 10 and 11, respectively 20 and 21, are articulated to the ridge member 3 in plates 30 and 31, respectively, visible in FIG. 3, according to different axes parallel to the axis X, so that they can be placed parallel to each other.

Referring now to FIGS. 1*b* and 1*c*, it is evident that the separation of the profile bars 40 and 41 permits to fold them, back by causing them to pivot according to the axes Y of the hinge joints 42, and, hence, this permits the bringing closer of the arches 1 and 2 by means of the hinge joints 52, 53, 54, 62, 63 and 64, the purlins 5 and 6 being positioned between the arches 1 and 2, the profile bars 50, 51, 60 and 61 being positioned against the profile bars 10, 21, 20 and 11, respectively.

In addition, because of the hinging of the profile bars 10, 11, 20 and 21 on the ridge members 3, it is possible to bring them closer parallel to the profile bars 40 and 41 and thus to obtain a compact unit easy to be transported.

It should also be noted that because of the hinging according to two axes of the profile bars 40 and 41 on their respective ridge member, it is possible, and even advantageous, to fold back each of these profile bars 40 and 41 along a profile bars 10 or 11, respectively 20 or 21.

In order to ensure a perfect rigidity of the whole structure when it is unfolded, hinge joints are provided with locking means.

Thus the hinge joints 52 and 62 include means permitting to block them, reversibly, the profile bars, 50 and 51, and 60 and 61, when they are unfolded, i.e. aligned. The locking means used can for example consist of ball indexing means.

The articulations 42 also include a locking system. Locking occurs through the co-operation of the encasing means of the profile bars 40 and 41 with each other, and of means controlling the pivoting according to the axis X.

The controlling means consist of means for indexing the angular position or each of the profile bars 40 and 41 with respect to its respective ridge member 3. In FIG. 3 can be seen a ridge member 3 including at the level of the region of interlocking of the profile bar 40 or 41, by means of the pivot 43, an indentation 33 designed to receive the end of the intermediate member 44, and whose shape defines the limits of the shifting of the member 44. In this case, and preferably, this indentation 33 is provided for permitting only a 90° pivoting of the member 44 and therefore of the profile bars 40 and 41.

It should be noted that the indentation 33 can be replaced by projecting elements having the same function, i.e. these judiciously disposed elements constitute stops for the member 44 and limit angularly the pivoting of the latter, the indentation being however preferred for reasons of size.

Thus, the indentation 33 defines two extreme angular positions of the pivot 43 and therefore two different extreme orientations of the pivot 45, in this case one horizontal permitting the folding back of the profile bar 40 or 41 between the profile bars 10, 11, and 20 and 21, the other vertical not permitting said folding back.

Since the two ridge members 3 are identical, the indentations 33 face each other so that the direction of pivoting of the profile bar 40 to cause the pivot 45 to pass from a horizontal orientation to a vertical orientation, is reversed to that of the profile bar 41 in order to perform the same operation.

Thus, after the unfolding of the structure and before the butting of the profile bars 40 and 41, it is necessary to cause the latter to pivot in reversed directions until they stop and in order for the two pivots 45 to be oriented vertically, then to encase the two profile bars 40 and 41 and to prevent the axial pivoting with respect to each other, which is achieved by the choice of the encasing indentations. Thus, self-blocking of the hinge fittings 42 is achieved, which ensures the rigidity of the structure.

According to a specific embodiment of the structure according to the invention, the encasing indentations, have a rectangular transversal cross-section.

Advantageously, the ridge members 3 are designed to be capable of receiving a ridge purlin 4 on each side, in order to permit the interlocking of an arch with two other ones.

Furthermore, it should be noted that the description above deals only with the roof portion of the structure, considering that the arches 1 and 2 can comprise other profile bars, not shown, each integral with one of the profile bars 10, 11, 20 and 21, near the hinge joint 53, 64, 63 and 54, respectively, and which constitute the feet of the structure.

I claim:

1. A folding modular structure for a tent comprising:

a plurality of tubular profile bars of a size suitable for supporting a canvas thereon, said plurality of tubular profile bars comprising a first plurality of bars forming a first arch and a second plurality of bars forming a second arch, said first arch facing said second arch and connected by at least two purlins, one of said at least two purlins being a ridge purlin, said ridge purlin formed of a pair of profile bars, one of said pair of profile bars of said ridge purlin connected by a first ridge member to said first arch, another of said pair of profile bars connected by a second ridge member to said second arch, each of said first and second ridge members comprising a first pivoting means for pivoting the profile bar relative to the ridge member along an axis perpendicular to a plane of the respective arch, each of said first and second ridge members further comprising an indexing means for angularly limiting the pivoting of the profile bar, each of said first and second ridge members comprising a second pivoting means for hinging an end of the profile bar along a transversal axis parallel to the plane of the respective arch such that said pair of profile bars folds inwardly from a longitudinally aligned position to a position parallel to said first and second arches, said ridge purlin comprising an encasing means for immobilizing an axial pivoting of one of said pair of profile bars with respect to the other of said pair of profile bars relative to an angular position defined by said indexing means.

2. The folding modular structure of claim 1, said indexing means comprising an intermediate member of a hinge joint, said intermediate member carrying a pair of pivots perpendicular to each other, one of said pair of pivots connecting the intermediate member to the ridge member perpendicular to the plane of the arch, another of said pair of pivots connecting the intermediate member to said ridge purlin.

3. The folding modular structure of claim 2, said indexing means comprising an indentation formed in the ridge member, said indentation being cooperative with said intermediate member.

4. The folding modular structure of claim 2, said indexing means comprising a plurality of elements projecting from the ridge member and cooperative with said intermediate member.

5. The folding modular structure of claim 1, each of the purlins other than said ridge purlin comprising two profile bars pivotally hinged to each other and pivotally hinged to the respective arch.

6. The folding modular structure of claim 5, each of the purlins other than said ridge purlin comprising a reversible blocking means for maintaining the two profile bars in alignment after unfolding.

7. The folding modular structure of claim 1, each of said first and second arches comprising the ridge member and a pair of rafters hinged to the ridge member.

* * * * *